United States Patent [19]

Donato et al.

[11] 4,437,142

[45] Mar. 13, 1984

[54] LIGHTING FIXTURE WITH SNAP REPLACEABLE BULB FEATURE

[75] Inventors: Anthony C. Donato, Westfield; Neil Russo, Howell, both of N.J.

[73] Assignee: Lightolier Incorporated, Jersey City, N.J.

[21] Appl. No.: 371,077

[22] Filed: Apr. 23, 1982

[51] Int. Cl.[3] ..... H01R 33/00

[52] U.S. Cl. ..... 362/226; 362/277; 362/282; 362/297; 362/322; 362/346; 362/347; 362/362

[58] Field of Search ..... 362/226, 277, 282, 297, 362/362, 346, 347, 322

[56] References Cited

U.S. PATENT DOCUMENTS 4,318,161 3/1982 Shanks ..... 362/226

4,318,162 3/1982 Sip ..... 362/226

*Primary Examiner*—Stephen J. Lechert, Jr.

*Attorney, Agent, or Firm*—Arthur B. Colvin

[57] ABSTRACT

The present invention is directed to a fixture which is characterized by its ability readily to be lamped and relamped, notwithstanding the fixture is located at a position which is accessible only with difficulty. The fixture includes a socket which coacts with the terminals of a bulb of particular design to center the terminals and to enable electrical and mechanical contact to be effected by a simple inward movement of the bulb relative to the socket.

8 Claims, 7 Drawing Figures

FIG.3
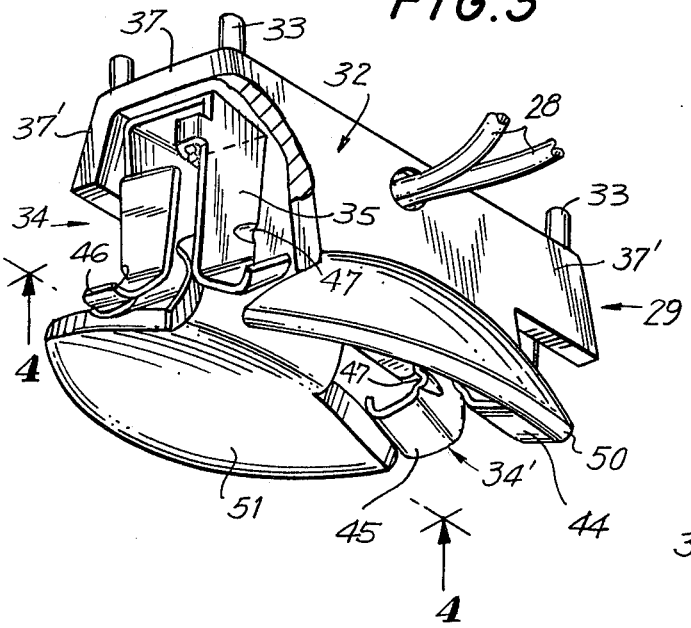
FIG.4
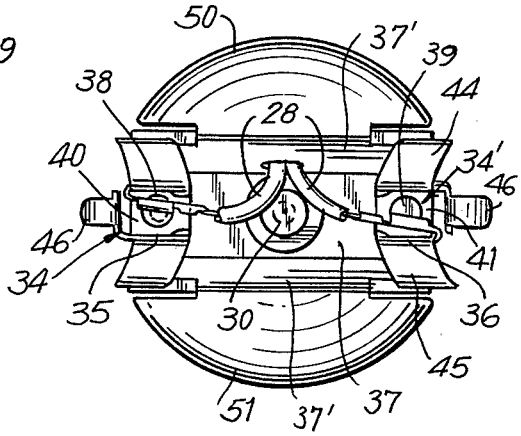
FIG.5
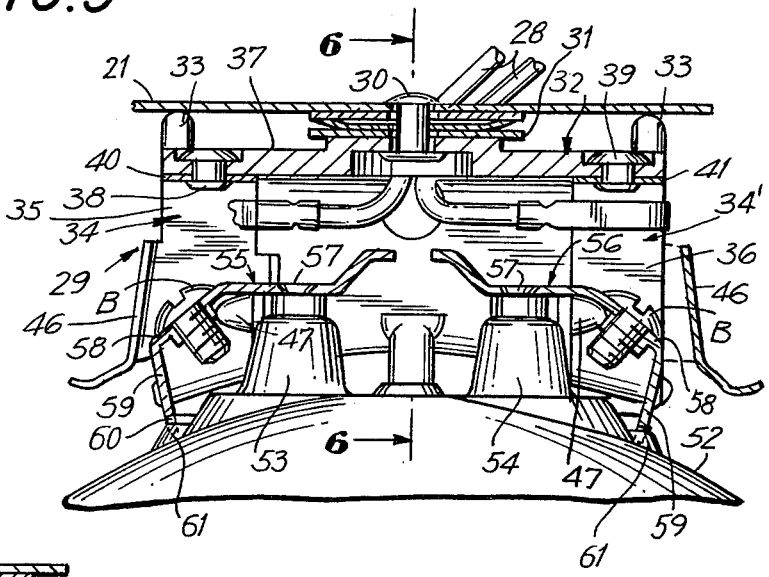
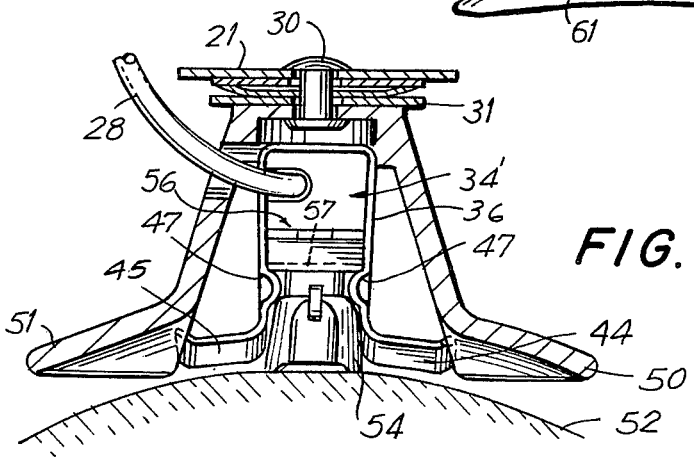
FIG.6

LIGHTING FIXTURE WITH SNAP REPLACEABLE BULB FEATURE

BACKGROUND OF THE INVENTION

The present invention relates to a lighting fixture and more particularly to a lighting fixture especially adapted for use with bulbs known generally as PAR bulbs. More particularly, the invention relates to a lighting fixture which may be readily relamped rendering the fixture particularly adapted for use in inaccessable locations.

THE PRIOR ART

In certain lighting applications increasing use has been made of a bulb or lamp known as the PAR lamp, the same referring to an essentially conventional, incandescent bulb operating at a low voltage e.g. 12 volts. The PAR lamp has the general configuration of an automotive headlight lamp being of a greater radial dimension than its axial or longitudinal dimension and having shallow convex front and rear surfaces.

The PAR lamp is provided on its rear surface with a spaced pair of metallic terminals disposed in a plane generally normal to the major axis of the bulb. The terminals are provided with short bolts tapped into the material thereof, connection to the lamp being effected by loosening the bolts and inserting the current carrying wires normally emanating from the secondary of a voltage reducing transformer, under the above described bolts prior to retightening.

From the noted description it will be apparent that lamping and lamp replacement in fixtures using bulbs of the PAR type is a tedious procedure. The difficulty of changing bulbs is compounded where the lighting fixture is located in an out-of-the-way position such as a high ceiling or a recessed installation.

While there exist lighting fixtures in the prior art which enable bulb attachment by snap-in action or frictional interfitting of contacts of the bulb with stationary contacts of the fixture, known devices of this sort have mandated a careful alignment of the interfitting components with a result that relamping, while more convenient than with the screw terminal type of installation, nonetheless requires the installer to be located in proximate relation to the fixture so as to visually align the interfitting parts.

Examples of known devices of the type above described are found in U.S. Pat. Nos. 320,117; 2,576,363; 2,749,529; 3,018,366; 3,218,488 and 3,735,116.

SUMMARY OF THE INVENTION

The present invention may be summarized as directed to an improved lighting fixture particularly adapted for use in conjunction with a PAR type bulb, wherein insertion of the bulb into operative contact with the energizing contacts may be readily effected without tools and without handling electrical conduits.

More particularly, the present invention is directed to a lighting fixture for a PAR type bulb wherein a snap-fit connection may be readily effected and wherein the fixture components embody guide means for leading the terminals of the bulb into operative position relative to the contacts of the fixture whereby the bulb and fixture cooperate responsive to inserting movements of the bulb to mutually guide the bulb components into a position whereat the terminals of the bulb and the contacts of the fixture will automatically engage responsive to inward movements of the bulb toward the fixture.

The invention is further directed to a device of the type described wherein an effective electrical contacting relationship between the respective terminals and contacts is assured responsive to insertion of the bulb into position. The invention is further directed to a device of the type described wherein the weight of the inserted bulb is borne principally by the gripping action derived from insertion of the bulb into position.

It is accordingly an object of the invention to provide an improved fixture particularly adapted for use with a PAR type bulb. A further object of the invention is the provision of a device of the type described wherein the bulb and the fixture incorporate complemental guiding surfaces whereby relamping may be effected substantially entirely by a simple pushing or pushing and rotating action, the guide surfaces functioning in the course of such action to align the contacts and terminals into a mutually oriented position for electrical conductive arrangement responsive to further inserting movements of the bulb.

Still further objects of the instant invention will appear herein or be hereinafter pointed out in connection with the description of the accompanying drawings wherein, FIG. 1 is a perspective view of a fixture in accordance with the invention.

FIG. 3 is a perspective view of the socket member of the fixture.

FIG. 4 is a bottom plan view on a reduced scale of the socket member of FIG. 3.

FIG. 5 is a vertical section through the terminal assembly showing portions of the PAR bulb juxtaposed to said socket.

FIG. 6 is a vertical section taken on the line 6—6 of FIG. 5.

Figure 1:
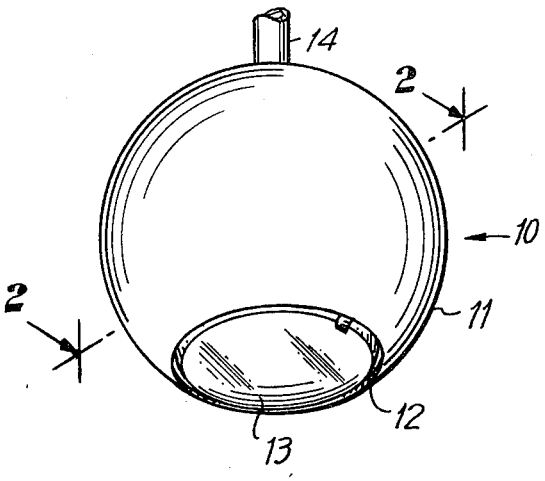
Figure 2:
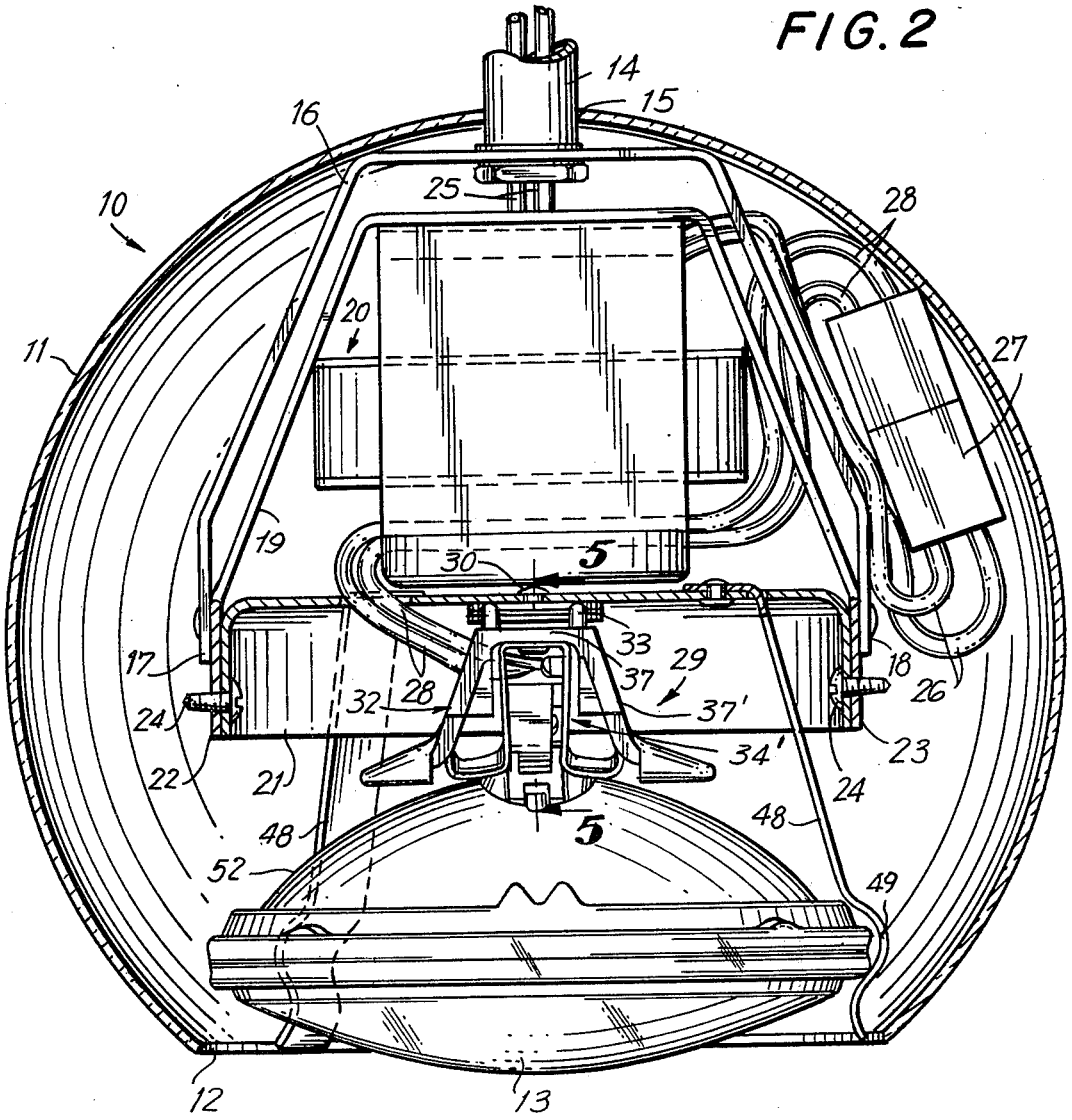
FIG. 2 is a magnified vertical sectional view taken on the line 2—2 of FIG. 1.

Referring now to the drawings there is shown in FIG. 1 by way of example, a lighting fixture 10 including a hollow housing 11 having a downwardly open mouth portion 12 through which projects a PAR bulb 13. Referring to FIG. 2 it will be apparent that the housing 11 depends from a tubular hanger member or pipe 14 extending through aperture 15 in the housing and that the electrical mains wires are disposed within the hanger 14.

A harp or frame member 16 is secured to the lower end of the member 14, the harp being in the general form of an inverted U. The distal ends 17,18 of the harp are secured to a further inverted U-shaped subframe 19 to which is mounted a voltage reducing transformer 20. An inverted cup-shaped mounting member 21 is secured between the free ends 22,23 of the mounting member 19 as by screws 24.

The mains leads 25—25 feed directly to the input of the transformer 20, the output or low voltage leads 26—26 being preferably led to a separable connector 27. The output leads 28—28 from the separable connector 27 are led to the terminals of a socket member 29 which forms the principal advance of the instant invention.

The socket member 29 is secured to the inverted cup 21 as by a rivet or like fastener 30, extending from the body of the socket through the cup 21. As will be apparent from an inspection of FIGS. 5 and 6 the rivet 30 may extend through a friction washer sandwich 31, which enables a restricted swiveling of the socket member 29 relative to the cup 21 about the vertical axis defined by the rivet 30.

The socket member 29 includes a substantially U-shaped body portion 32 which is formed of a heat resistant insulating material such as a molded impregnated phenolic, an epoxy or the like. The body portion 32 has an upper wall portion 37 and side wall portions 37'. Preferably the upper wall portion 37 includes a plurality of upwardly directed integral studs 33, which bear against the undersurface of the cup member 21 to achieve a spacing of the body portion 32 from the cup.

The body portion 32 includes a pair of contact members 34,34', each having contact fingers 35,36 electrically connected to one of the two low voltage conduits 28. The contact members 34,34' are formed of a springy metallic conductive material, such as phosphor bronze, and are secured to the upper wall portion 37 as by rivet members 38,39 which extend through the base portions 40,41 of the contact members 34 and 34' respectively.

Referring more particularly to FIGS. 3 through 6 it will be perceived that the contact members 34,34' are generally in the configuration of inverted U's. Since the contact members 34 and 34' are for all intents and purposes identical a description of one will suffice.

Each pair of spaced depending contact fingers 36 of each contact member has outwardly projecting extensions 44,45 respectively. As best seen from FIGS. 3 and 6 the undersurfaces of the extensions 44 and 45 are inclined inwardly and upwardly both toward the longitudinal center line of the channel defined between the spaced fingers 36 and toward the geometric center as represented by the rivet 30 and define cam means for spreading the fingers 36 by coaction with the terminals 55,56 of the bulb. Each of the contact members, in addition, include a centering tab 46 aligned with the associated channel defined between the pair of contact fingers, which tab is likewise inclined upwardly and inwardly toward the rivet 30. The fingers or legs 35,36 of each of the contact members 34,34' include detent portions 47 defined by a depression in opposing faces of the fingers or legs 35,36, the detents 47 extending inwardly toward the center line of the channel between the pairs of legs 35,36, which function as a bulb retainer, the detents being in opposed relation and defining a narrowed neck portion therebetween.

The insulating body portion 32, integrally with the side wall portions 37' thereof, is provided with a pair of wings or shell like deflector members 50, 51. The undersurfaces of the shells 50,51 are inclined upwardly and inwardly and are preferably concave and partispherical in configuration. The inclination of the undersurfaces of the shells 50,51 is preferably such as to correlate essentially with the curved configuration of the rear or upper surface 52 of the PAR light.

As will be apparent from the preceding description, the net effect of the inclined portions 44,45 and 46 of the fingers 36 and the undersurfaces of the shells 50,51 is to define a downwardly facing concavity, all surfaces of which converge toward the center axis of the socket member 29.

The general configurations of the conventional PAR lamp are best appreciated from an inspection of FIGS. 5 and 6. The lamp includes on its rear surface 52 a spaced pair of upwardly directed pylons 53,54. Each of the pylons houses an upwardly directed conduit (not shown), each such conduit in turn being electrically connected to one of the terminal strips 55 or 56. The terminal strips 55,56 are essentially identical in configuration each including a generally horizontal central portion 57, an inclined side face 58 and a depending reinforcing strut 59 which engages against the uppersurface of the bulb. For stability the reinforcing struts may be centrally apertured as at 60, which central apertures span rib members 61 projecting upwardly from the rear face of the bulb. As previously indicated the bulb is entirely conventional per se and details thereof are mentioned merely to facilitate an appreciation of their interaction with the components of the socket member 29.

In the assembled positions of the bulb in the socket shown in FIG. 5 and FIG. 6, the flat central portions 57 of the terminals of the bulb are clampingly disposed between the opposed fingers 36 of the contact member 34' of the fixture. More particularly, the opposed fingers 36 clamp about the outer edges of the flat central portions 57, the detents 47 entering beneath said flat portions and functioning to cam the flat portions upwardly. The spring compressive forces of the fingers 36 thus function to retain the terminals of the bulb in clamped relation assuring a firm and efficient electrical conductive arrangement between the contacts of the socket member and the terminals of the bulb.

As will be apparent from the preceding description lamping and relamping of the fixture is greatly simplified and may be effected in areas which are visually inaccessible. In order to insert a lamp it is merely necessary to force the base of the lamp upwardly into contact with the socket member. By virtue of the shape of the undersurface of the fixture the lamp is essentially self-locating relative to the socket member.

When the lamp member is pressed upwardly and assuming that the terminal strips 55,56 are not in alignment with the transverse channel defined between the fingers of each contact member 34,34' of the socket member, normally the bolts B will engage against the undersurface of the shell portions 50,51. When such contacting arrangement is effected it is merely necessary to press the bulb upwardly while simultaneously rotating same about its central axis. By virtue of the cam configuration or inclination of the portions 46, the upward pressing and rotation functions, when the terminals of the bulb become aligned with the channel between the contact fingers, to deflect the contact fingers outwardly whereupon the bulb will snap into operative position within the socket member.

Optionally, a plurality of spring retainer legs 48 may extend downwardly from the cup member 21, the legs including a recess 49 within which the periphery of the bulb will be disposed to stabilize the bulb against tilting movements. It should be understood, however, that the members 48 are not a necessary element and that the forces which secure the bulb against falling clear of the fixture are supplied entirely by the connection between bulb and socket member.

Removal of a bulb which has burned out is accomplished by merely grasping the bulb and pulling the same clear of the socket member and fixture 10, such pulling forces overcoming the spring forces of the fingers 35 and 36 and spreading the latter.

Figure 7:
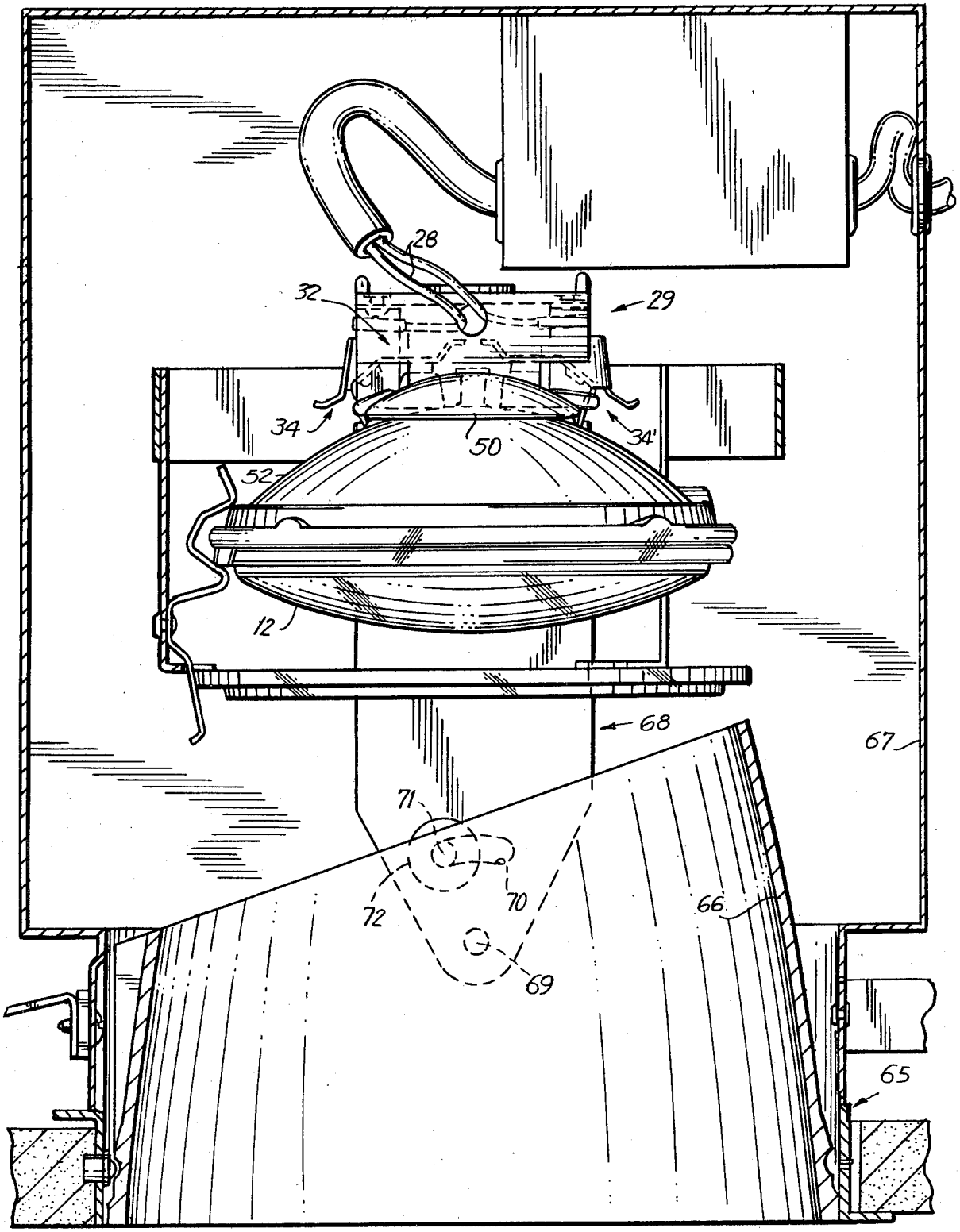
FIG. 7 is a vertical sectional view of a fixture in accordance with an embodiment of the invention.

The embodiment of FIG. 7 is essentially identical in all pertinent details as respects the socket member and bulb connection, but shows the socket member in the environment of a modified housing. More specifically, a frame member 65 mounted to a ceiling or ceiling support structure includes a depending reflective cowl 66 mounted at the lower end and an upper reflector 67. A support frame, in the configuration of an inverted U bracket 68, is pivotedly mounted as at spaced pivot points 69 to the cowl 66. The legs of the bracket 68 are provided with opposed arcuate slots 70 (only one slot being shown) within which slots ride limit pins 71 made fast to the cowl.

Spring frictions washers 72 sandwiched between the cowl and the legs of bracket 68 limit the freedom with which the bracket may swing about the pivot point 69.

The fixture 29 is identical to that previously described.

From the foregoing description it will be apparent that there is described in accordance with the present invention an unique fixture with a socket member particularly adapted for the reception of a PAR lamp or like lamp having contacts defined by metallic bands on the rearface of the bulb. A characterizing feature of the invention resides in the fact that the bulb may be mounted by a simple upward movement and that if the terminal components of the bulb and the contact components of the fixture are not initially in alignment, such alignment may be readily achieved by merely rotating the bulb relative to the fixture. Such rotation automatically results in the bulb snapping into an electrical connective relation to the fixture when an alignment of the components is achieved.

The nature of the connection effected by the bulb terminal components and contacts of the fixture is such as to mechanically support the bulb as well as provide an effective electrical connection between bulb and socket member contacts.

Those persons skilled in the art and familiarized with the instant disclosure will readily perceive that variations on the concept hereinabove described may be made without departing from the spirit of the invention. Accordingly, the present invention is to be broadly construed within the scope of the appended claims.

Having thus described the invention and illustrated its use, what is claimed as new and is desired to be secured by Letters Patent is:

1. A lighting fixture for a PAR lamp or like bulb of the type which includes a shallow body having a convex rear surface including a rearwardly facing pair of generally flat metallic terminal strips, including portions arrayed in generally coplanar alignment perpendicular to the longitudinal axis of said bulb, said fixture comprising a reflector housing, a socket member mounted within said housing, said socket member including an insulating body portion having a transversely extending downwardly open cross channel, a pair of alignment wings formed from said body portion, each said wing having a undersurface portion merging with an opposite boundary of said channel, said undersurfaces being generally concave and converging upwardly and inwardly toward the geometric center of said channel, said wings together defining a funnel configuration leading into said channel, a pair of contact members recessed within said channel and adapted to be connected to a current source, said contact members each including a pair of spring finger portions, the finger portions of each pair being disposed at opposite sides of said channel, cam means on said fingers positioned to coact with the terminals of said bulb for spreading the fingers of each pair responsive to upward movements of said terminal strips within said channel and retainer portions on said fingers positioned to enter behind said terminals strips and restrain said bulb after seating, against movement outwardly of said channel.

2. A fixture in accordance with claim 1 in which said retainer portions are formed integrally from said fingers.

3. A fixture in accordance with claim 1 wherein said cam means comprise inclined caming surfaces integrally formed from said fingers.

4. A fixture in accordance with claim 1 wherein said fingers include upwardly directed cam surfaces, said surfaces in the inserted position of said bulb being biased against said terminal strips of said bulb responsive to the spring forces of said fingers, said cam surfaces being inclined to deflect said terminals strips upwardly past said retaining portions.

5. A fixture in accordance with claim 1 wherein each of said pair of contact members includes a further cam portion aligned with said channel, said further cam portion being inclined upwardly toward said geometric center.

6. A fixture in accordance with claim 5 wherein said wings, said cam means on said fingers and said further cam means together define a concave configuration in the general form of an inverted funnel to thereby coact with the uppermost portions of said bulb and center same responsive to upward movements of said bulb against said socket member.

7. A fixture in accordance with claim 1 in which a plurality of spring legs are provided to coact with the periphery of said lamp to enhance the retention thereof in the fixture.

8. A fixture in accordance with claim 1 in which said reflector housing has a cylindrical body portion depending below said socket member, a cowl member is positioned in the lower portion of said cylindrical housing substantially vertically aligned with the socket member and means are provided pivotally to mount said cowl on a transverse axis.

* * * * *